United States Patent [19]

Buckley

[11] Patent Number: 4,568,903

[45] Date of Patent: Feb. 4, 1986

[54] MOUNTING FOR IGNITION MODULE

[75] Inventor: Francis P. Buckley, Springfield, Mass.

[73] Assignee: R. E. Phelon Company, Inc., East Longmeadow, Mass.

[21] Appl. No.: 691,215

[22] Filed: Jan. 14, 1985

[51] Int. Cl.[4] ..... H01F 27/30

[52] U.S. Cl. ..... 336/197; 310/194; 336/198

[58] Field of Search ..... 310/214, 216, 194; 336/96, 196, 197, 198, 205

[56] References Cited

U.S. PATENT DOCUMENTS 1,996,606 4/1935 Ayers ..... 336/197 X 2,266,618 12/1941 Stimson ..... 336/197 X

*Primary Examiner*—Thomas J. Kozma

*Attorney, Agent, or Firm*—Chapin, Neal & Dempsey

[57] ABSTRACT

Mounting for ignition module in which a ferromagnetic flux carrying core includes a plurality of spaced, parallel leg portions. An ignition coil module has a generally central opening which is adapted to receive one of the core legs. One recess is provided on the outer surface of the module, and a second recess is provided in the core leg adjacent the one on which the module is disposed. The two recesses are oriented and dimensioned to form complementary portions of an opening adapted to receive a resiliently flexible retaining pin therein to fasten the module and core in assembled relation.

6 Claims, 7 Drawing Figures

Fig. 1.
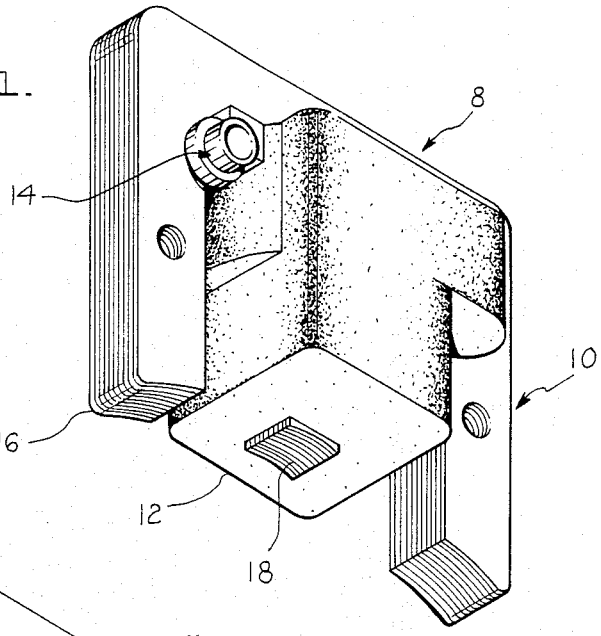
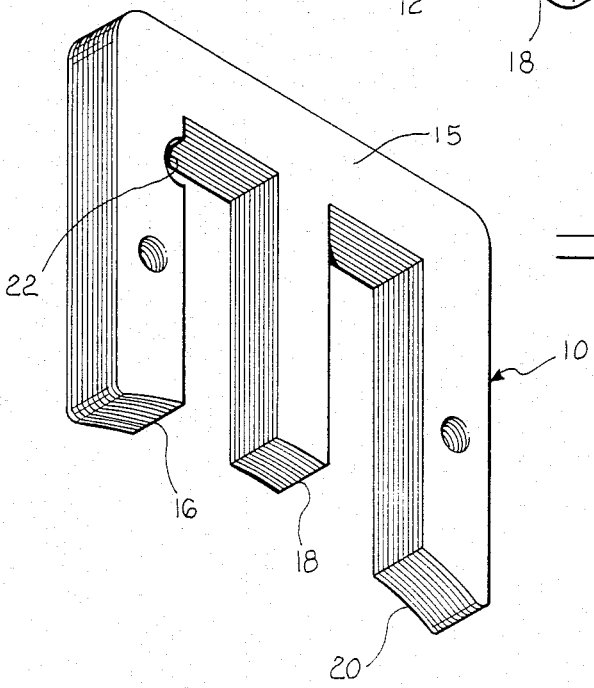
Fig. 2.
Fig. 3.
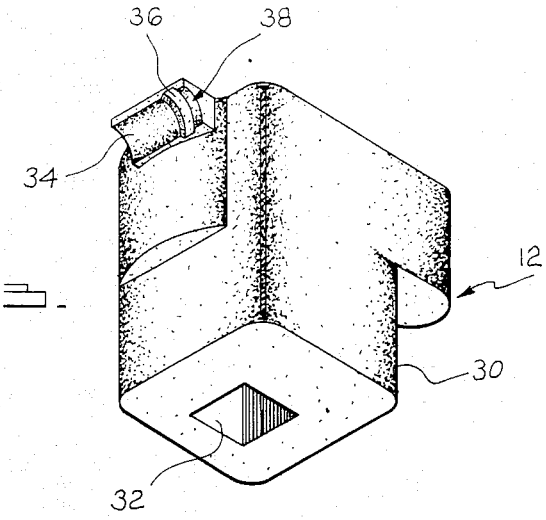

MOUNTING FOR IGNITION MODULE

BACKGROUND OF THE INVENTION

Various methods and means have been used in the past for fastening the coil module onto a leg portion of a flux carrying armature or core.

In one such method, the coil module is bonded onto the core leg by using an epoxy resin bonding agent. The major drawback of this technique is that it does not lend itself to automated processing and the application of the epoxy for effective bonding is time consuming.

Other methods have involved the use of metallic mounting clips especially adapted to be affixed to the core at their inner ends and with an angle or bend at their upper ends to capture and hold the module in fixed position on the core leg. Among the drawbacks of using these metal clips, is that they tend to absorb some of the electromagnetic energy generated in the coil and reduce the kilovolt output of the ignition coil. Moreover, such clips must be fastened to the core and to the module and thus they are not readily adaptable to automated assembly techniques.

The principal effect of this invention is to provide a novel, simple, economical and highly effective means for fastening a coil module to a flux carrying core.

Another object of this invention is to provide means for fastening a coil module to a flux core which is adaptable to automated assembly procedures.

The above and other objects or advantages of this invention will be more readily appreciated by a reading of the following description read in conjunction with the accompanying drawings in which:

FIG. 1 is a perspective view of a coil/core assembly of the type used in magneto ignition systems;

FIG. 2 is a perspective view of the core element of the assembly;

FIG. 3 is a perspective view of the coil module portion of the assembly;

Figure 4:
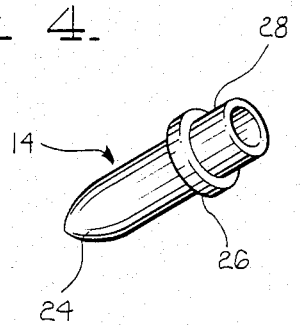
FIG. 4 is a perspective view of the retaining pin used in the assembly.

Referring in detail to the drawings, in FIG. 1 an ignition coil/core assembly is shown generally at 8. The assembly comprises an E-shaped, multi-leg core 10 and an ignition coil module 12 mounted on the core.

The core 10, also shown in FIG. 2, comprises a laminated structure of sheet metal plates fastened together, such as by riveting or the like (not shown). The core includes a cross-bar portion 15 and three parallel leg portions 16, 18 and 20 extending outwardly therefrom and the terminal ends of the legs are radiused. The core provides a flux path for magnet poles rotated past the core legs in the conventional manner. At a point adjacent the cross-bar 15, the leg 16 includes a circular cutout or recess 22 to assist in the assembly procedure, as will hereinafter be more fully described.

The module 12 comprises a synthetic plastic shell of generally rectangular configuration 30. The shell is generally a premolded polypropylene material into which is fitted in the primary and secondary windings of an ignition coil. Also, an electronic control circuit may be fitted into the shell which is then filled with a dielectric potting compound. An opening or chimney 32 extends axially through approximately the central portion of the coil. This opening is generally rectangular in cross-section and is dimensioned to be slightly larger than the cross-section of the core leg 18 to provide sufficient clearance for ease of assembly. Adjacent the upper or inner end of the module 12, as disposed on the core 10, is an outwardly extending portion 38 which is provided with a concave surface or recess 34. The recess is approximately one quarter of a cylinder having its longitudinal axis d (FIG. 5) disposed transversely of the longitudinal axis e (FIG. 7) of the chimney 32. The recess 34 includes an annular groove 36 adjacent one end.

Figure 7:
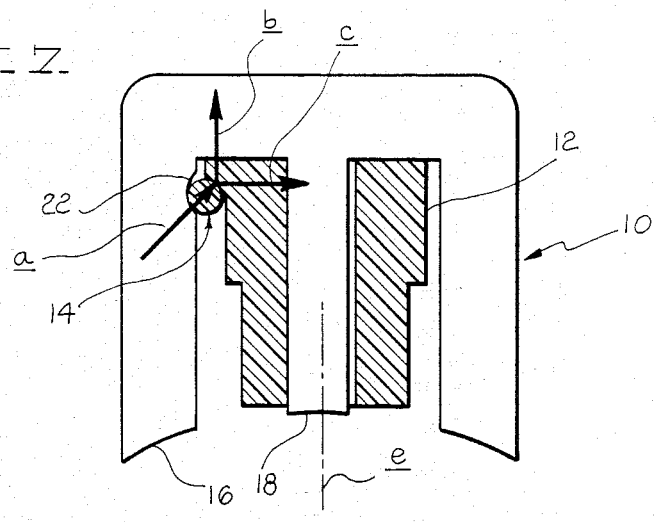
FIG. 7 is an elevational view of the assembly partly in section which illustrates the geometric relationship of the components.

As best shown in FIG. 7, the concave cylindrical surface 34 provided on the module 12 and the concave cylindrical surface 22 formed in the upper, inner edge portion of the leg 16 are complementary portions of a cylinder. The recess 22 is approximately semi-cylindrical and recess 34 is approximately a quarter of a circle.

When the upper surface of the module 12 is disposed in contact with the cross-bar 15 of the core, the two arcuate surfaces define a partial cylindrical opening of about 270 degrees in circumference with a predetermined diameter, slightly less than the diameter of a retaining pin 14.

The pin 14 is a resilient member of generally cylindrical cross-section and, as shown, has an ogival tip portion 24 at one end and an annular flange 26 which extends radially outward of the cylindrical surface adjacent the other end 28 of the pin. The pin may be solid or, as illustrated in FIG. 4, may be tubular in cross-section. The leading edge of the flange 26 is of tapered or conical configuration to facilitate insertion of the locking pin in the opening defined by the recess 22 and 34. The pin 14 may be made of any suitably resilient material and, for example, may be molded of a synthetic plastic material, including suitable thermoplastic or thermosetting materials, such as a polyester or phenolic resin. Preferably, the molding composition includes a filler or fiber content such as glass or graphite fibers or mineral particles for enhanced strength. The fiber or mineral content of the composite is preferably made relatively high and the wall thickness of the tubular pin is selected such that the pin will have a high modulus of elasticity which will remain essentially constant for the expected life of the coil.

Figure 5:
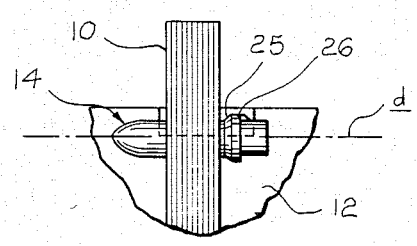
FIG. 5 is a partial side-elevational view illustrating the relationship between the various parts of the assembly.
Figure 6:
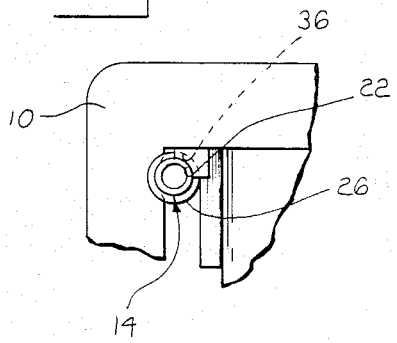
FIG. 6 is a partial front-elevational view of the same parts as shown in FIG. 5.

To assemble the coil/core structure of this invention, coil module 12 is telescopically fitted onto the middle leg 18 of the core 10. The upper end of the module is pressed against the cross-bar 15 of the core and the locking pin 14 is axially inserted into the opening defined by the spaced opposed, cylindrical surface portions 22 in the core and 34 on the module. A rod-like tool may be used to drive the pin into its fully locked position, as best shown in FIG. 5, with the flange 26 fitted into groove 36 so that the pin will be locked in a fixed axial position on the assembly. The diameter of the pin 14 is somewhat greater than the diameter of the partial cylinder defined by the two surfaces 22 and 34 so that the pin will be radially compressed when inserted therebetween. Radial compression of the pin results in an upwardly and inwardly directed force vector a (FIG. 7). This diagonal vector is the resultant of two right angled components b and c which are respectively parallel to axis e of the chimney 32 and perpendicular to the axis e. These components ensure that the core will remain axially and transversely fixed on the center leg 18 of the core 10.

This construction, moreover, permits relatively easy assembly of the coil module onto the core by the simple expedient of inserting the resilient locking pin in the cylindrical opening defined by partial cylindrical surfaces 22 and 34.

Having thus described this invention, what is claimed is:

1. In a coil/core assembly having a flux carrying core with a cross-bar portion and at least two laterally spaced, parallel leg portions and with a coil module disposed on one of said leg portions, the improvement comprising means for fastening together the coil and core in assembled relation, a first concave recess on said coil module and a second concave recess on the other core leg portion, the recesses being disposed in spaced, opposed relation and forming an opening therebetween, and a locking pin disposed in tensioned relation in said opening formed in part by said two concave recesses.

2. In a coil/core assembly, as set forth in claim 1, in which said pin is a resilient, tubular member which is in radial compression when disposed in said opening.

3. In a coil/force assembly, as set forth in claim 2, in which the tubular pin comprises a fiber reinforced synthetic plastic composite and includes an annular flange portion, the recess on said module includes a groove adapted to receive said flange therein for securely fastening said pin in fixed axial position within said opening.

4. In a coil/core assembly, as set forth in claim 3, in which the module comprises a molded synthetic plastic shell with a central opening therethrough dimensioned to telescopically fit onto said one leg portion, said module having an inner end portion disposed in abutting relation to the cross-bar portion of the core, the first recess being integral with the coil module and being of partial cylindrical configuration, the second recess also being of partial cylindrical configuration and said pin being of cylindrical cross-section with an outer diameter greater than the dimetrical distance between the first and second recesses so that said pin is radially compressed in a direction which results in reactive force components which urge the module laterally toward the one leg portion of the core and inwardly toward the cross-bar portion thereof.

5. In a coil/core assembly, as set forth in claim 4, in which said pin has an ogival end portion and an open end, said annular flange including a beveled inner end surface for aiding in the snap-fitting interengagement of the flange within said annular groove.

6. In a coil/core assembly, as set forth in claim 5, wherein said first recess is approximately a cylindrical quadrant and said second recess is approximately semicircular, said recesses having a common geometric center, a diameter bisecting the arc defined by said quadrant extending diagonally toward the cross-bar and center leg portions of the core.

* * * * *